US012629739B2

(12) United States Patent
Khorshidian

(10) Patent No.: US 12,629,739 B2
(45) Date of Patent: May 19, 2026

(54) PLEATING MACHINE FOR MANUFACTURING CORRUGATED WIRE MESH

(71) Applicant: INDUSTRIAL CLIMATE SOLUTIONS INC., Calgary (CA)

(72) Inventor: Hossein Khorshidian, Calgary (CA)

(73) Assignee: INDUSTRIAL CLIMATE SOLUTIONS INC., Calgary (CA)

( * ) Notice: Subject to any disclaimer, the term of this patent is extended or adjusted under 35 U.S.C. 154(b) by 285 days.

(21) Appl. No.: 18/470,043

(22) Filed: Sep. 19, 2023

(65) Prior Publication Data

US 2025/0091110 A1 Mar. 20, 2025

(51) Int. Cl.
*B21D 13/02* (2006.01)

(52) U.S. Cl.
CPC ..... *B21D 13/02* (2013.01)

(58) Field of Classification Search
CPC ..... B21D 13/02; B21D 13/00; B21D 11/18; B21D 11/20
See application file for complete search history.

(56) References Cited

U.S. PATENT DOCUMENTS 4,245,576 A 1/1981 Crawford et al.
6,442,836 B1 * 9/2002 Chen ..... B21D 13/02 72/383
6,942,708 B2 9/2005 Peter et al.
7,510,518 B2 3/2009 Heinen et al.
2022/0001640 A1 1/2022 Fiello
2022/0096985 A1 3/2022 Tate et al.

FOREIGN PATENT DOCUMENTS

CN 116329351 A * 6/2023 ..... B21D 13/02

OTHER PUBLICATIONS

JCEM, "Blade Pleating Equipment"; https://www.jcem.group/blade-pleating-machinery; 2020; 8 pages.
Roth Composite Machinery; "Pleating & Coating"; Retrieved from the internet Jun. 2, 2023; https://www.roth-composite-machinery.com/de/roth-geschaeftsbereiche-pleating-coating.htm 2 pages.

* cited by examiner

*Primary Examiner* — Debra M Sullivan
(74) *Attorney, Agent, or Firm* — CANTOR COLBURN LLP

(57) ABSTRACT

A pleating machine and a method of corrugating a blank. The blank defines a starting plane. The pleating machine includes a first blade pair and a second blade pair. The first blade pair is configured to anchor the blank at a first location of the blank and the second blade pair is configured to anchor the blank at a second location of the blank. The first blade pair moves vertically with respect to the starting plane during a corrugation operation, and the second blade pair is constrained to move within the starting plane during the corrugation operation. The first blade pair and the second blade pair move cooperatively to form a corrugation in the blank.

14 Claims, 9 Drawing Sheets

PLEATING MACHINE FOR MANUFACTURING CORRUGATED WIRE MESH

BACKGROUND

In the resource recovery and fluid sequestration industries, a screen is used to remove particles from fluids. The screen can be corrugated or pleated to facilitate flow of multiphase fluids. Conventional corrugation techniques corrugate the screen a single fold at a time. This results in low throughput and increased manufacturing costs. Therefore, there is a need for a system and method for corrugation that can perform multiple corrugation cycles simultaneously.

SUMMARY

Disclosed herein is a pleating machine. The pleating machine includes a first blade pair configured to anchor a blank at a first location of the blank, the blank defining a starting plane, wherein the first blade pair is configured to move vertical with respect to the starting plane during a corrugation operation, and a second blade pair configured to anchor the blank at a second location of the blank and constrained to move within the starting plane during the corrugation operation, wherein the first blade pair and the second blade pair move cooperatively to form a corrugation in the blank during the corrugation operation.

Also disclosed herein is a method of corrugating a blank. The method includes anchoring the blank at a first location via a first blade pair and at a second location via a second blade pair, the blank defining a starting plane, wherein the first blade pair is configured to move vertically out of the starting plane and the second blade pair is constrained to move within the starting plane, moving the first blade pair vertically out of the starting plane to corrugate the blank at the first location during a corrugation operation, and moving the second blade pair within the starting plane to corrugate the blank at the second location.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
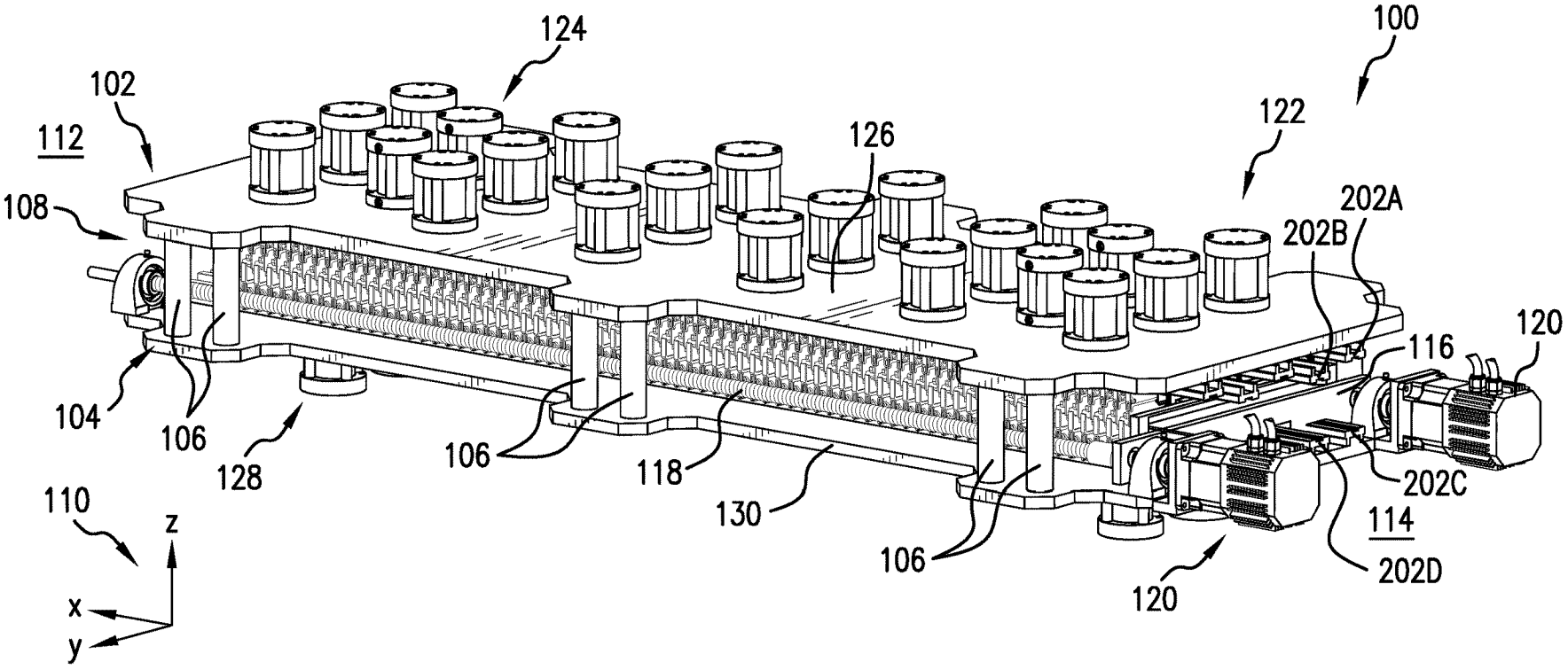
FIG. 1 shows a perspective view of a pleating machine in an illustrative embodiment.

FIG. 1 shows a perspective view of a pleating machine 100 in an illustrative embodiment. The pleating machine 100 includes a first plate 102 (upper plate) and a second plate 104 (lower plate) separated by support beams 106 to form a gap 108. A coordinate system 110 is shown for illustrative purposes. The pleating machine 100 is aligned with the coordinate system 110 with a length extending along a first axis (referred to herein as an x-axis), a width extending along a second axis (referred to herein as a y-axis) and a height extending along a third axis (referred to herein as a z-axis). A motion along the x-axis may be referred to herein as "lengthwise motion". A motion along the z-axis may be referred to herein as "vertical motion". A blank can be fed lengthwise into the gap 108 along the x-axis starting at a receiving end 112 to settle between the first plate 102 and the second plate 104. A closed end 114 of the pleating machine is opposite to the receiving end 112 and includes a movable stop 116. Once the blank is inserted within the gap 108, a fixed stop can be secured at the receiving end 112 to confine the blank between the fixed stop and the movable stop 116. The blank can be a flat sheet of metal, a wire mesh, or other material suitable for corrugation.

A set of lead screws 118 extends along the x-axis and is mechanically coupled via their threads to the movable stop 116. Lengthwise actuators 120 can be used to rotate the lead screws 118, thereby moving the movable stop 116 along the x-axis. In various embodiments, the lengthwise actuators 120 can include a motor, a hydraulic actuator or a pneumatic actuator.

The first plate 102 includes a plurality of upper rails (see FIG. 2) extending within the gap 108 along the length of the first plate 102. The upper rails support a first set of upper blades and a second set of upper blades. A first set of vertical actuators 122 and a second set of vertical actuators 124 are located on an outer surface 126 of the first plate 102. The first set of vertical actuators 122 can be used to move the first set of blades vertically along the z-axis, and the second set of vertical actuators 124 can be used to move the second set of blades along the z-axis.

Similarly, the second plate 104 includes a plurality of lower rails (see FIG. 2) extending within the gap 108 along the length of the second plate 104. The lower rails support a first set of lower blades and a second set of lower blades. A third set of vertical actuators 128 on the outer surface 130 of the second plate 104 can be operated to move the first set of lower blades along the z-axis. The vertical actuators can be coordinated to perform an anchoring operation and a corrugation operation to produce a corrugated blank, as discussed herein.

Figure 2:
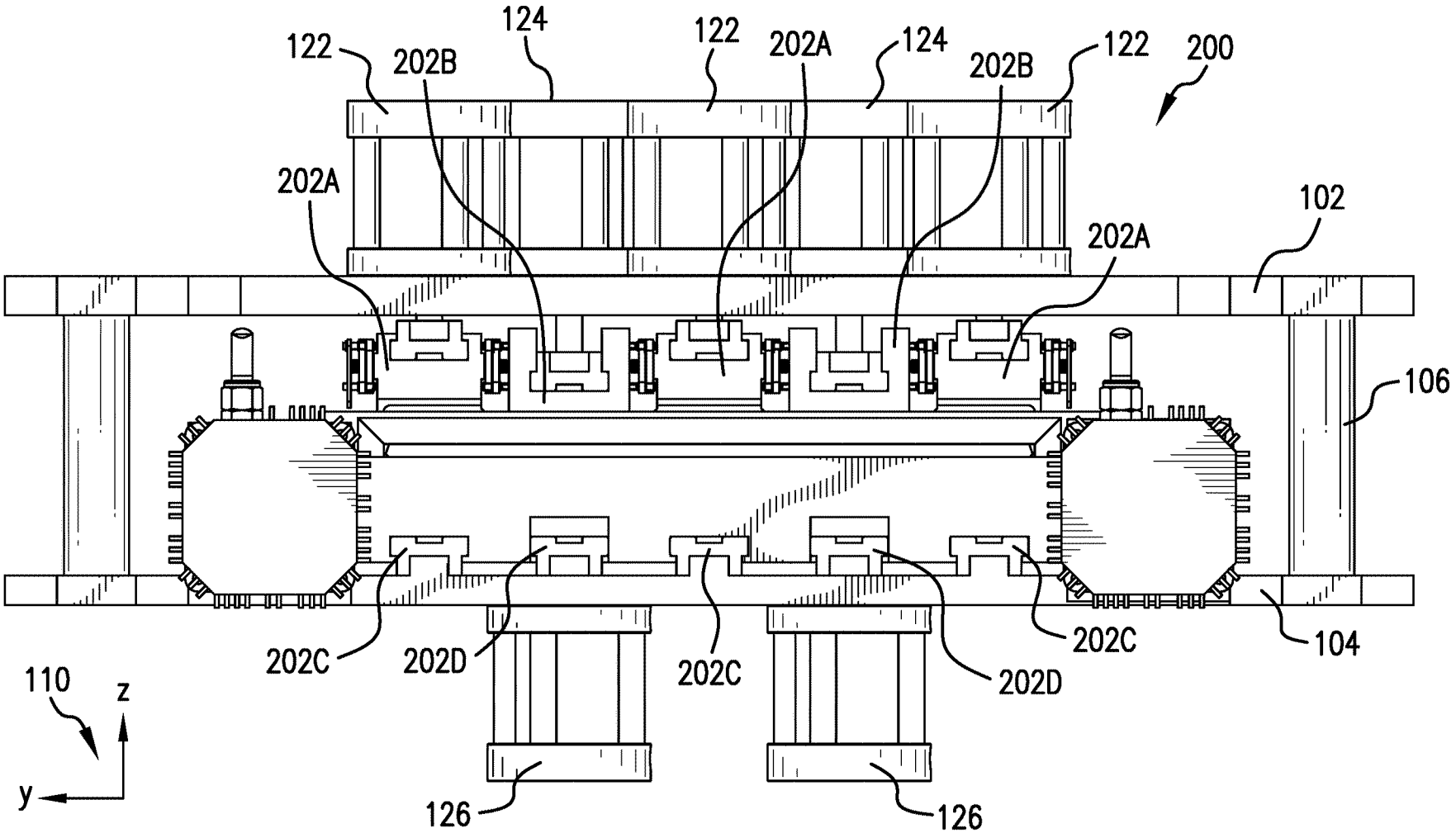
FIG. 2 shows an end view of the pleating machine as viewed from the closed end along the x-axis.

FIG. 2 shows an end view 200 of the pleating machine 100 as viewed from the closed end 114 along the x-axis. The end view 200 shows upper rails and lower rails. A first set of upper rails 202A and a second set of upper rails 202B are arranged along the y-axis in an alternating sequence (A, B, A, B, . . . ). Similarly, a first set of lower rails 202C and a second set of lower rails 202D are arranged along the y-axis in an alternating sequence (C, D, C, D, . . . ). The upper set and the lower set are arranged so that the first set of upper rails 202A is opposite the first set of lower rails 202C along the z-axis and the second set of upper rails 202B is opposite the second set of lower rails 202D along the z-axis. The first set of upper rails 202A is coupled to the first set of vertical actuators 122 and the second set of upper rails 202B is coupled to the second set of vertical actuators 124. The first set of upper rails 202A and the second set of upper rails 202B are therefore movable with respect to the first plate 102 along the z-axis. The first set of lower rails 202C is fixed to the second plate 104. The second set of lower rails 202D is coupled to the third set of vertical actuators 128 and is movable with respect to the second plate 104 along the z-axis.

Figure 2A:
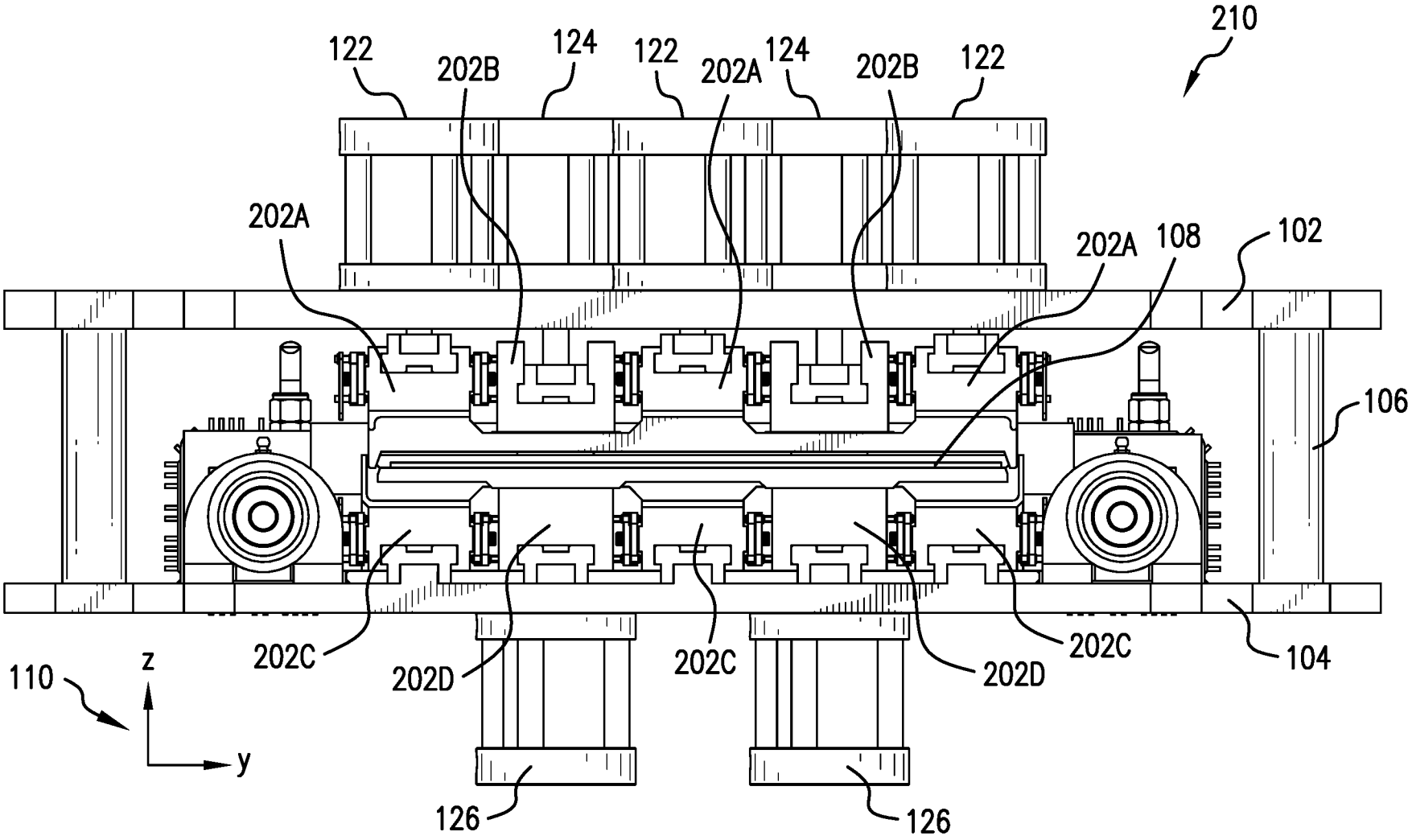
FIG. 2A shows an end view of the pleating machine as viewed from the receiving end along the x-axis.

FIG. 2A shows an end view 210 of the pleating machine 100 as viewed from the receiving end 112 along the x-axis. The end view 200 shows the first set of upper rails 202A, second set of upper rails 202B, first set of lower rails 202C and second set of lower rails 202D. The first set of upper rails 202A is shown coupled to the first set of vertical actuators 122 and the second set of upper rails 202B is shown coupled to the second set of vertical actuators 124. The first set of lower rails 202C is shown fixed to the second plate 104. The second set of lower rails 202D is shown coupled to the third set of vertical actuators 128 and is movable with respect to the second plate 104 along the z-axis. The gap 108 into which the blank is fed is shown.

Figure 3:
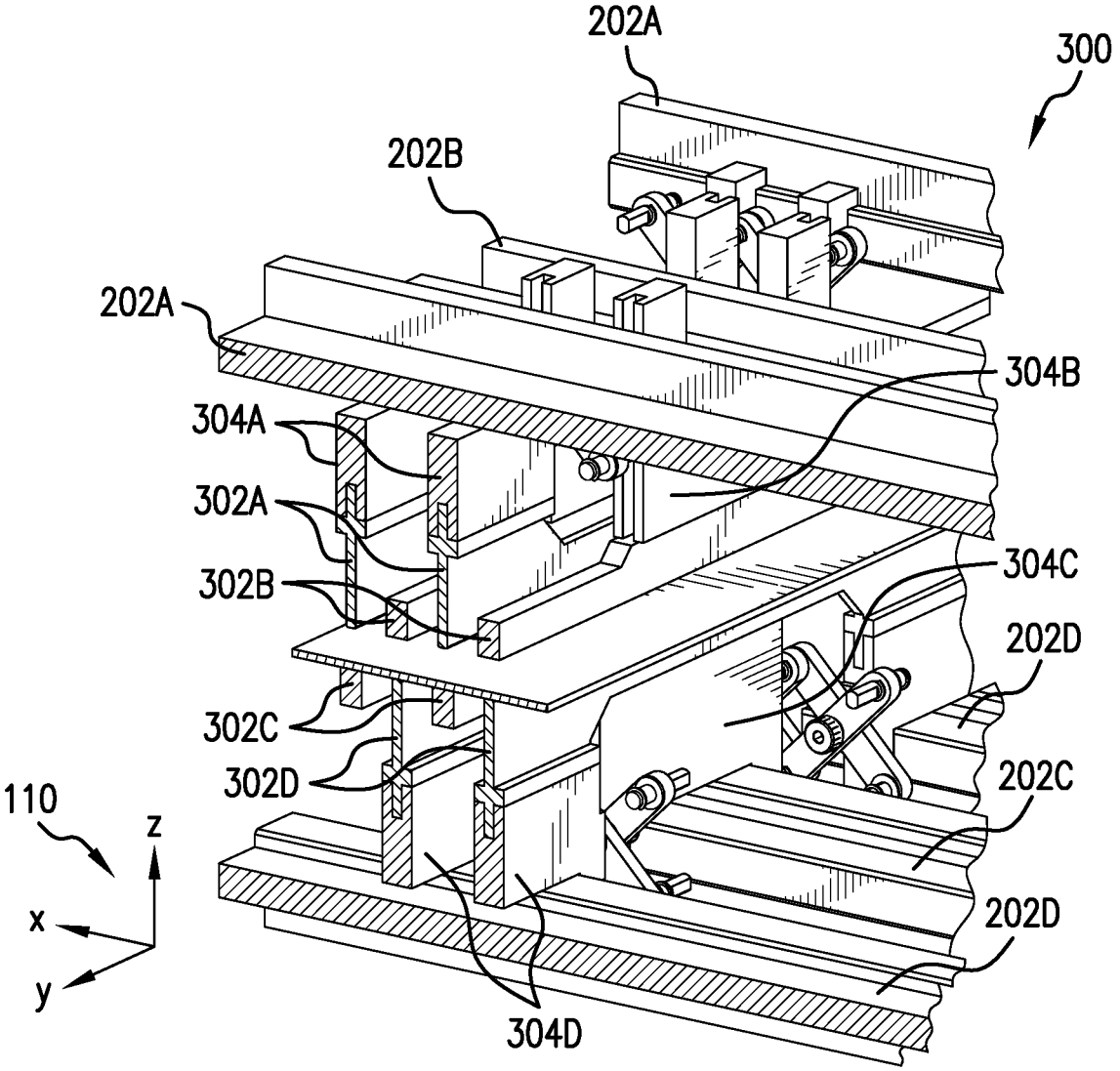
FIG. 3 shows a perspective view of the receiving end of the pleating machine.

FIG. 3 shows a perspective view 300 of the receiving end 112 of the pleating machine 100. Only two blade cycles are shown for ease of explanation. However, it is understood that the pleating machine 100 includes any number of blade cycles. The perspective view 300 shows a first set of upper blades 302A and a second set of upper blades 302B. The first set of upper blades 302A and the second set of upper blades 302B include multiple blades which are arranged along the x-axis in an alternating sequence (A, B, A, B, . . . ). Each blade extends across the gap 108 along the y-axis. The first set of upper blades 302A are coupled to the first set of upper rails 202A via a first set of upper bearings 304A which allow the first set of upper blades 302A to slide with respect to the first set of upper rails 202A along the x-axis. Similarly, the second set of upper blades 302B are coupled to the second set of upper rails 202B via a second set of upper bearings 304B which allow the second set of upper blades 302B to slide with respect to the second set of upper rails 202B along the x-axis.

The perspective view 300 also shows a first set of lower blades 302C and a second set of lower blades 302D. The first set of lower blades 302C include multiple blades which are arranged along the x-axis in an alternating manner (C, D, C, D, . . . ). Each blade extends across the gap 108 along the y-axis. The first set of lower blades is coupled to the first set of lower rails 202C via a first set of lower bearings 304C which allow the first set of lower blades 302C to slide with respect to the first set of lower rails 202C along the x-axis. Similarly, the second set of lower blades 302D is coupled to the second set of lower rails 202D via a second set of lower bearings 304D which allow the second set of lower blades 302D to slide with respect to the second set of lower rails 202D along the x-axis.

The blades are arranged so that blades from the first set of upper blades 302A are opposite blades from the first set of lower blades 302C along the z-axis and blades from the second set of upper blades 302B are opposite blades from the second set of lower blades 302D along the z-axis. In various embodiments, the blades can be placed at any location along the y-axis.

Referring to FIGS. 2 and 3, the first set of vertical actuators 122 controls the vertical motion of the first set of upper rails 202A and therefore can move the first set of upper blades 302A along the z-axis. Similarly, the second set of vertical actuators 124 controls the vertical motion of the second set of upper rails 202B and therefore can move the second set of upper blades 302B along the z-axis. The third set of vertical actuators 128 control the vertical motion of the second set of lower rails 202D and therefore can move the second set of lower blades 302D along the z-axis.

The vertical actuators can be coordinated to perform an anchoring operation and/or a corrugation operation. The anchoring operation includes clamping the blank between the blades by lowering the upper blades and raising the lower blades. The first set of vertical actuators 122 and the second set of vertical actuators 124 can be operated together to lower the first set of upper blades and the second set of upper blades simultaneously onto the top surface of the blank. Additionally, the vertical position of the first set of lower blades can be aligned with the vertical position of the second set of lower blades. In the corrugation operation, the first set of upper blades 302A and the first set of lower blades 302C are activated simultaneously, independently of the second set of upper blades.

Figure 4:
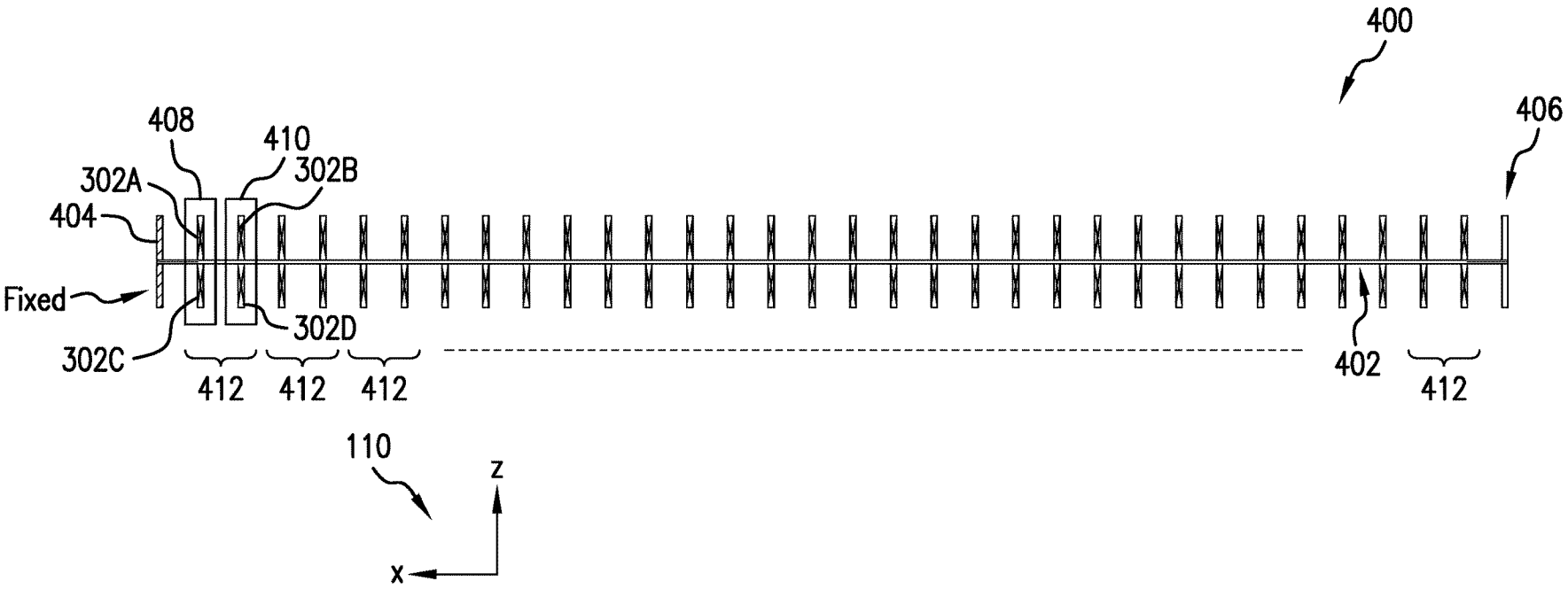
FIG. 4 shows a side view of a blank anchored between blades at a starting point of a corrugation operation.

FIG. 4 shows a side view 400 of a blank anchored between blades at a starting point of a corrugation operation. The blank 402 is disposed between a fixed end 404 and a free end 406 (i.e., movable stop 116) along the x-axis and between a first upper blade 302A and a second upper blade 302B (from above) and a first lower blade 302C and a second lower blade 302D (from below). The first upper blade 302A and the first lower blade 302C cooperate to form a first blade pair 408 that clamps the blank 402 at a first location. Similarly, the second upper blade 302B and the second lower blade 302D cooperate to form a second blade pair 410 that clamps the blank 402 at a second location. The first blade pair 408 and the second blade pair 410 adjacent to the first blade pair 408 form a blade cycle 412. A plurality of blade cycles is shown along the length of the blank. The action that occurs in one blade cycle occurs simultaneously in the other blade cycles. Prior to the corrugation operation, the blank defines a starting plane (e.g., the x-y plane). Corrugation causes the blank to deform with respect to the starting plane.

Figure 5:
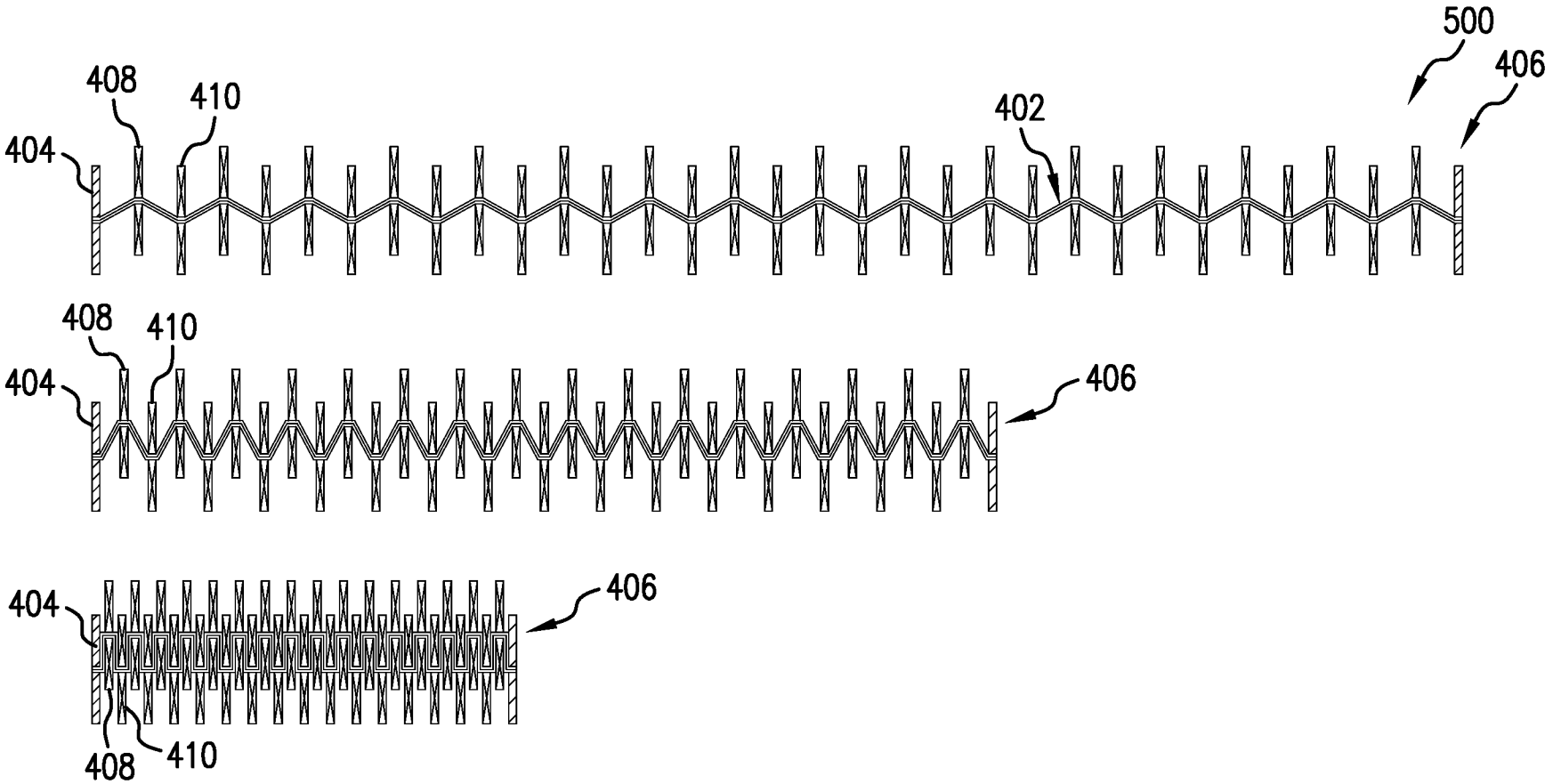
FIG. 5 shows a side view of various stages of the pleating operation performed on the blank.

FIG. 5 shows a side view 500 of various stages of the pleating operation performed on the blank. The first blade pair 408 is free to move along both the z-axis and the x-axis, while the second blade pair 410 is constrained to move only along the x-axis.

To start the corrugation operation, each first blade pair 408 is moved upward along the z-axis. This motion causes the blank 402 to fold at the first location to form a concave downward section. The motion also exerts a force along the x-axis at the second blade pair 410 that causes the second blade pair 410 to move toward the fixed end 404. The first blade pair 408 and the second blade pair 410 both move in the x-direction. Since this action is duplicated across the blade cycles 412, the blade pairs simultaneously form multiple corrugations across the length of the blank. As the corrugation process continues, the length of the blade cycles reduces. The free end 406 is moved toward the fixed end 404 during the pleating process and can be used to compress the blank along the x-axis.

Figure 6:
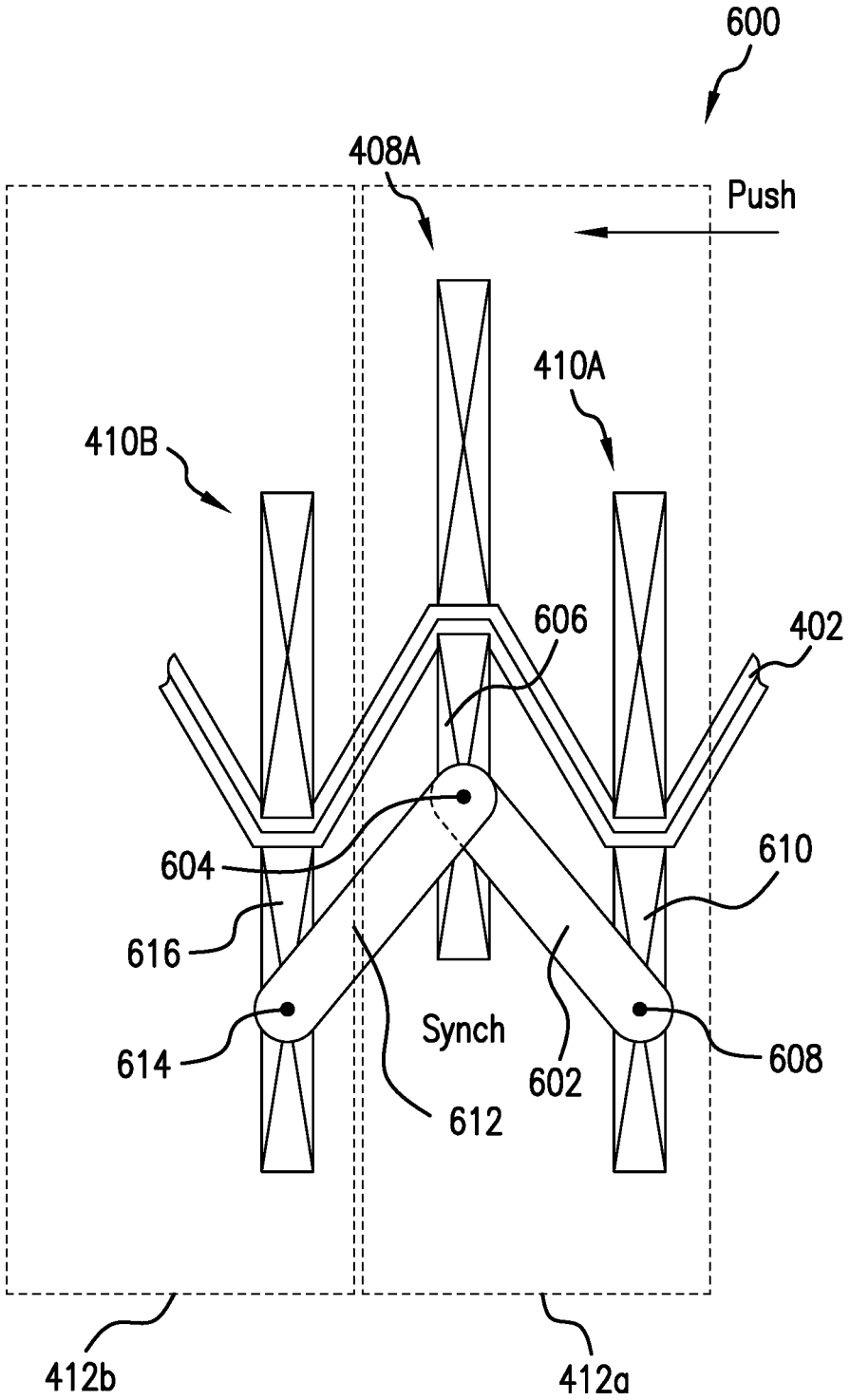
FIG. 6 shows a section of a pleated blank that illustrates a section of a pivot assembly.

FIG. 6 shows a section 600 of a pleated blank that illustrates a section of a pivot assembly for synchronizing movement of adjacent blade pairs along a horizontal direction. The pivot assembly controls the movement of the first blade pair 408 and the second blade pair 410. A first pivot arm 602 connects the first blade pair 408A and the second blade pair 410A within a first blade cycle 412A. A first end of the first pivot arm 602 is secured to a pin 604 on a lower blade 606 of the first blade pair 408A and a second end of the first pivot arm 602 is secured to a pin 608 of a lower blade 610 of the second blade pair 410A. The first pivot arm 602 is capable of rotating with respect to the pins 604, 608.

Similarly, a second pivot arm 612 connects the first blade pair 408A of the first blade cycle 412A to a second blade pair 410B of an adjacent second blade cycle 412B. A first end of the second pivot arm 612 is secured to a pin 614 on a lower blade 616 of the second blade pair 410B and a second end of the second pivot arm 612 is secured to pin 604. The second pivot arm 612 is capable of rotating with respect to the pins 604, 614. As the blank 402 folds, the pivot arms 602, 612 rotate to equalize forces between adjacent blade pairs, thereby resulting in even corrugation folds.

The pivot assembly extends across a plurality of blade cycles and facilitates the synchronized movement of blades as they travel along the x-axis. Thus, all blades of the first blade pair (e.g., first upper blades 302A and corresponding first lower blades 302C) have an identical vertical travel in y-axis. In addition, the pivot assembly maintains an identical horizontal spacing between blade pairs as they travel along the x-axis.

Figure 7:
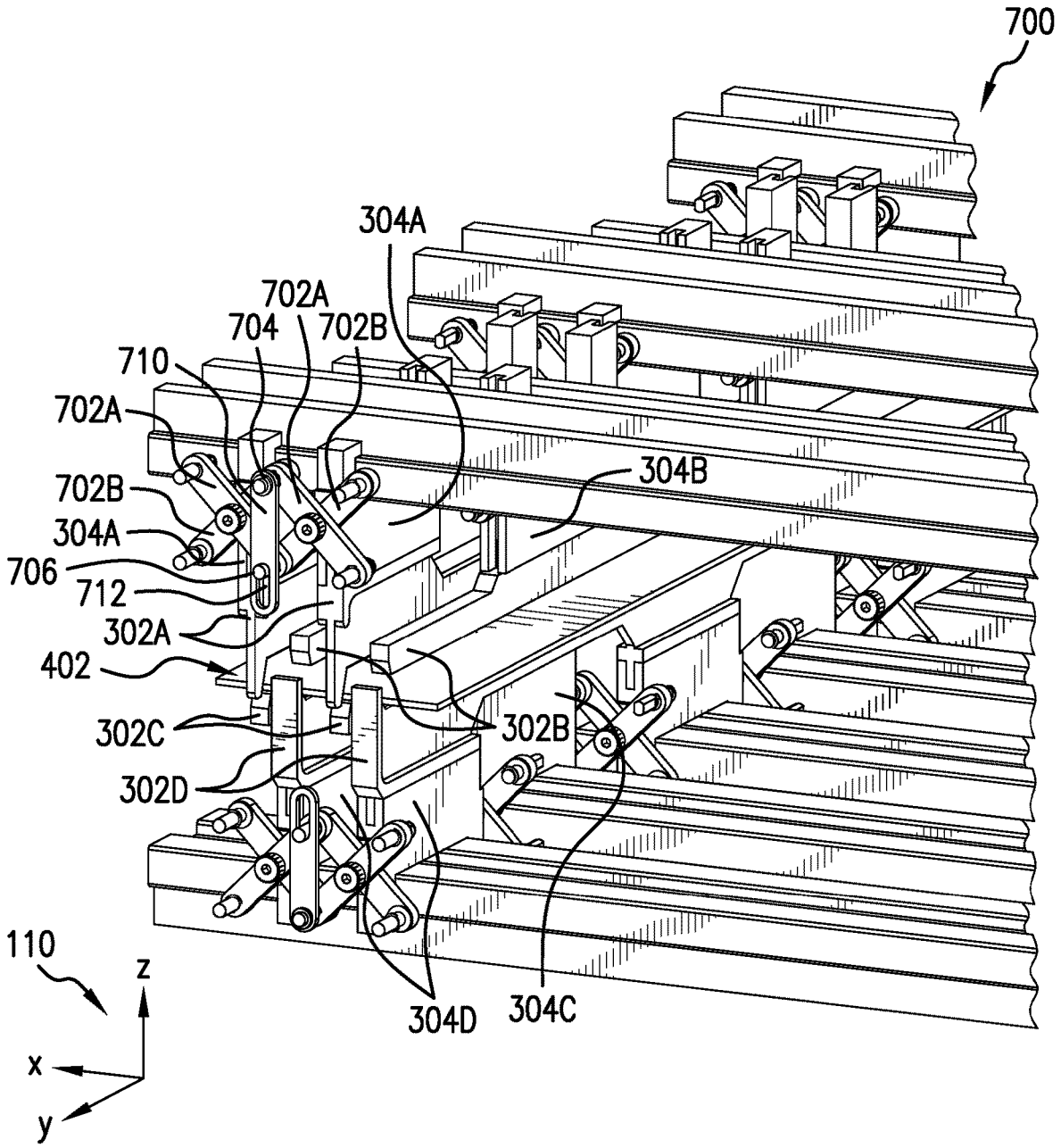
FIG. 7 shows a perspective view of the receiving end of the pleating machine in a pivot assembly.

FIG. 7 shows a perspective view 700 of the receiving end of the pleating machine 100 in a pivot assembly. The perspective view 700 shows a pivot assembly for synchronizing movement of blade pairs within a same set (i.e., blade pairs within the first set of blade pairs) along a horizontal direction. The pivot assembly includes an upper set of pivot arms 702 attached to the first set of upper bearings 304A. One blade cycle (i.e., two adjacent blade pairs) creates 1.5 cycles of pleating at the blank 402, including one completed ridge and one completed valley, as well as a half ridge or half valley. Each bearing of the first set of upper bearings 304*a* has a pivot pair attached. Each pivot pair includes a first pivot arm 702A and a second pivot arm 702B which are attached through their center to an associated bearing so that they can move along a y-axis. The first pivot arm 702A and the second pivot arm 702B are arranged in a cross. An end of the first pivot arm 702A associated with one bearing is attached to an end of a second pivot arm 702B for an adjacent bearing to form a first pivot intersection 704. Similarly, an end of the second pivot arm 702B associated with one bearing is attached to an end of a first pivot arm 702A for an adjacent bearing to form a second pivot intersection 706. A pivot rail 710 is coupled to the first pivot intersection 704 and includes an elongated slot 712 that allows a pin at the second pivot intersection 706 to move therein. As the distance between the bearings decreases, the pivot pairs maintain forces between the bearings (and thus the blade pairs). A similar set of pivot arms is attached to the second set of upper bearings 304B. Also, a similar set of pivot arms is attached to the first set of lower bearings 304C, and a similar set of pivot arms is attached to the second set of lower bearings 304D.

The elongated slot 712 controls the relative angles of the pivot arms 702A and 702B when they are in a fully compressed configuration and a fully retracted configuration. Thus, the blades can be repeatably retracted back to a selected position that allows receiving a new blank for a subsequent pleating operation.

Figure 8:
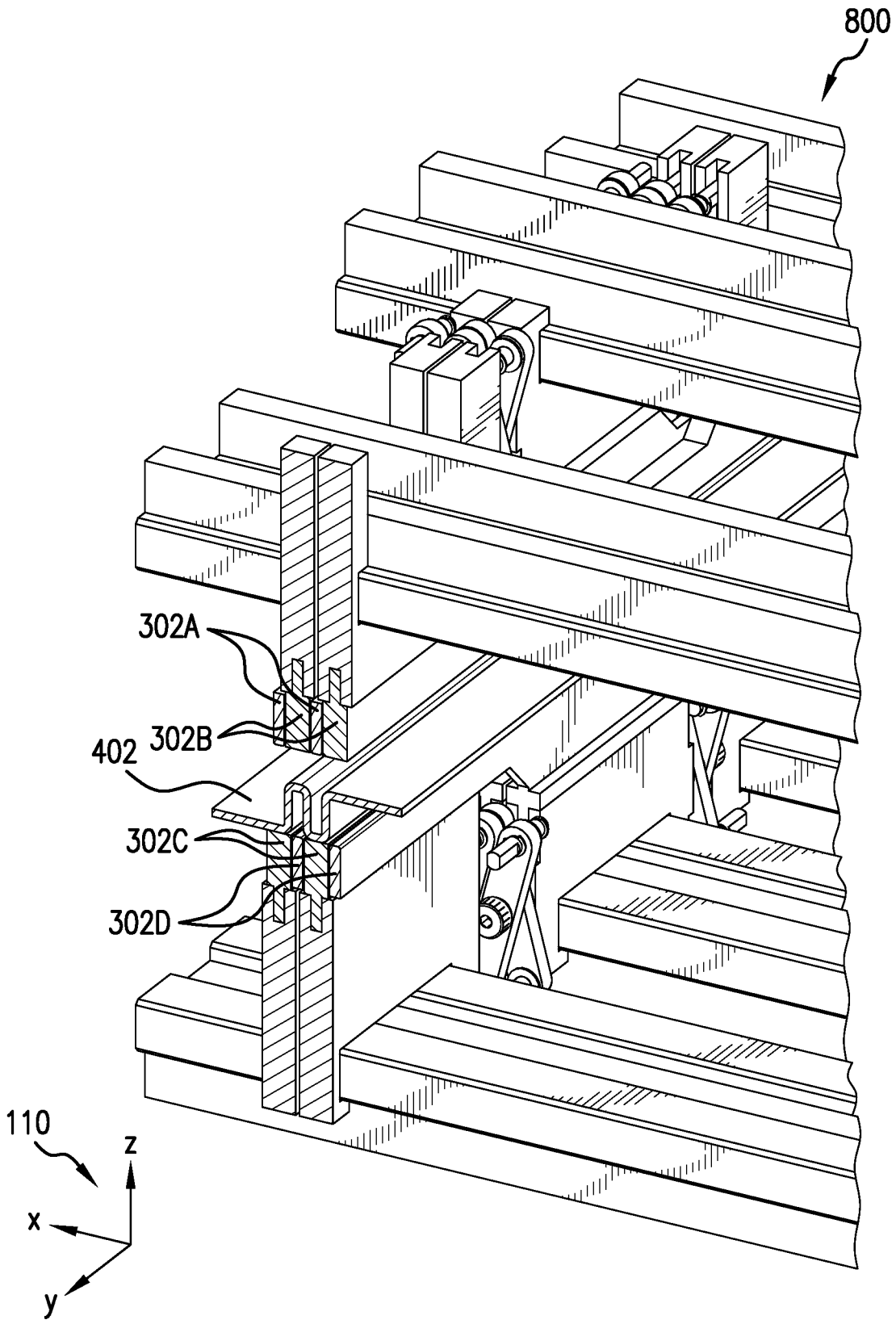
FIG. 8 shows a final stage of the corrugation process.

FIG. 8 shows a perspective view 800 of the receiving end of the pleating machine 100 illustrating a final stage of the corrugation process. The corrugations are formed in the blank and the blade pairs are separated. The first set of upper blades 302A and the second set of upper blades 302B are raised upward. The first set of lower blades 302C is moved downwards. The blank 402 can then be removed from the gap 108. It is noted that the blank 402 can relax by expanding along the x-axis once released. Therefore, the corrugation process can include compressing the blank along the x-axis to an amount more than is desired. Thus, when the blank relaxes, the final state of the corrugated blank fits desired dimensions.

Set forth below are some embodiments of the foregoing disclosure:

Embodiment 1. A pleating machine. The pleating machine includes a first blade pair configured to anchor a blank at a first location of the blank, the blank defining a starting plane, wherein the first blade pair is configured to move vertically with respect to the starting plane during a corrugation operation, and a second blade pair configured to anchor the blank at a second location of the blank and constrained to move within the starting plane during the corrugation operation, wherein the first blade pair and the second blade pair move cooperatively along a length of the starting plane to form a corrugation in the blank during the corrugation operation.

Embodiment 2. The pleating machine of any prior embodiment, wherein the first blade pair is further configured to move along the length of the starting plane during the corrugation operation.

Embodiment 3. The pleating machine of any prior embodiment, wherein the first blade pair comprises a first upper blade and a first lower blade on opposite sides of the blank and configured to move in opposing vertical directions to clamp the blank at the first location during an anchoring operation and to move in the same horizontal direction during the corrugation operation.

Embodiment 4. The pleating machine of any prior embodiment, wherein the second blade pair comprises a second upper blade and a second lower blade configured to move in opposing vertical directions along to clamp the blank at the second location during the anchoring operation.

Embodiment 5. The pleating machine of any prior embodiment, further comprising a pivot assembly connecting the first blade pair to the second blade pair.

Embodiment 6. The pleating machine of any prior embodiment, wherein the first blade pair and the second blade pair form a blade cycle and a plurality of blade cycles extend along the length of the blank, wherein the pivot assembly connects the plurality of blade cycles to maintain equal forces across the plurality of blade cycles.

Embodiment 7. The pleating machine of any prior embodiment, further comprising a fixed stop and a movable stop configured to move toward the fixed stop during the corrugation operation.

Embodiment 8. The pleating machine of any prior embodiment, further comprising a lengthwise actuator configured to move the movable stop and vertical actuators to move the first blade pair and the second blade pair.

Embodiment 9. The pleating machine of any prior embodiment, wherein the pivot assembly allows for consistent retracting of the blade pairs to a selected position for receiving a blank for a subsequent corrugation operation.

Embodiment 10. A method of corrugating a blank includes anchoring the blank at a first location via a first blade pair and at a second location via a second blade pair, the blank defining a starting plane, moving the first blade pair vertically out of the starting plane to corrugate the blank at the first location during a corrugation operation, and moving the second blade pair along a length of the starting plane and within the starting plane to corrugate the blank at the second location.

Embodiment 11. The method of any prior embodiment, further comprising moving the first blade pair along the length of the starting plane during the corrugation operation.

Embodiment 12. The method of any prior embodiment, wherein the first blade pair comprises a first upper blade and a first lower blade on opposite sides of the blank, further comprising moving the first upper blade and the first lower blade in opposing vertical directions to clamp the blank at the first location and moving the first upper blade and the first lower blade in the same horizontal direction to corrugate the blank.

Embodiment 13. The method of any prior embodiment, wherein the second blade pair comprises a second upper blade and a second lower blade, further comprising moving the second upper blade and the second lower blade in opposing directions to clamp the blank at the second location.

Embodiment 14. The method of any prior embodiment, further comprising maintaining a distance between the first blade pair and the second blade pair via a pivot assembly connecting the first blade pair to the second blade pair.

Embodiment 15. The method of any prior embodiment, wherein the pivot assembly includes a first pivot arm having a first end and a second pivot arm having a second end, wherein the first end is rotatably coupled to the second end.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve providing porous media for use gas processing and purification, CO2 capture, gas sweetening, etc. The porous media can be used in a trickle flow reaction beds, a pulsating flow packed bed, a gas-liquid absorption column, etc.

While the invention has been described with reference to an exemplary embodiment or embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A pleating machine, comprising:

a first blade pair configured to anchor a blank at a first location of the blank, the blank defining a starting plane, wherein the first blade pair is configured to move vertically with respect to the starting plane during a corrugation operation;

a second blade pair configured to anchor the blank at a second location of the blank and constrained to move within the starting plane during the corrugation operation, wherein the first blade pair and the second blade pair move cooperatively along a length of the starting plane to form a corrugation in the blank during the corrugation operation;

a fixed stop; and a movable stop configured to move toward the fixed stop during the corrugation operation.

2. The pleating machine of claim 1, wherein the first blade pair is further configured to move along the length of the starting plane during the corrugation operation.

3. The pleating machine of claim 1, wherein the first blade pair comprises a first upper blade and a first lower blade on opposite sides of the blank and configured to move vertically in opposing directions to clamp the blank at the first location during an anchoring operation and to move in the same direction during the corrugation operation.

4. The pleating machine of claim 3, wherein the second blade pair comprises a second upper blade and a second lower blade configured to move in opposing vertical directions to clamp the blank at the second location during the anchoring operation.

5. The pleating machine of claim 1, further comprising a pivot assembly connecting the first blade pair to the second blade pair.

6. The pleating machine of claim 5, wherein the first blade pair and the second blade pair form a blade cycle and a plurality of blade cycles extend along the length of the blank, wherein the pivot assembly connects the plurality of blade cycles to maintain equal forces across the plurality of blade cycles.

7. The pleating machine of claim 6, wherein the pivot assembly allows for consistent retracting of the blade pairs to a selected position for receiving a blank for a subsequent corrugation operation.

8. The pleating machine of claim 1, further comprising a lengthwise actuator configured to move the movable stop and vertical actuators to move the first blade pair and the second blade pair.

9. A method of corrugating a blank, comprising:

anchoring the blank at a first location via a first blade pair and at a second location via a second blade pair, the blank defining a starting plane and disposed between a fixed stop and a movable stop;

moving the first blade pair vertically out of the starting plane to corrugate the blank at the first location during a corrugation operation;

moving the second blade pair along a length of the starting plane and within the starting plane to corrugate the blank at the second location; and moving the movable stop toward the fixed stop as the blank is being corrugated.

10. The method of claim 9, further comprising moving the first blade pair along the length of the starting plane during the corrugation operation.

11. The method of claim 9, wherein the first blade pair comprises a first upper blade and a first lower blade on opposite sides of the blank, further comprising anchoring the blank at the first location by moving the first upper blade and the first lower blade in opposing vertical directions to clamp the blank at the first location and corrugating the blank by moving the first upper blade and the first lower blade in the same horizontal direction.

12. The method of claim 11, wherein the second blade pair comprises a second upper blade and a second lower blade, further comprising anchoring the blank at the second location by moving the second upper blade and the second lower blade in opposing vertical directions to clamp the blank at the second location.

13. The method of claim 9, further comprising maintaining a distance between the first blade pair and the second blade pair via a pivot assembly connecting the first blade pair to the second blade pair.

14. The method of claim 13, wherein the pivot assembly includes a first pivot arm having a first end and a second pivot arm having a second end, wherein the first end is rotatably coupled to the second end.

* * * * *